US007296647B2

(12) United States Patent
Wittenstein

(10) Patent No.: US 7,296,647 B2
(45) Date of Patent: Nov. 20, 2007

(54) TRANSPORT DRIVE IN PARTICULAR FOR STAGE ELEMENTS, FORK-LIFT VEHICLES AND MOVING PLATFORMS

(75) Inventor: Manfred Wittenstein, Mergentheim (DE)

(73) Assignee: Wittenstein AG, Igersheim (DE)

( * ) Notice: Subject to any disclaimer, the term of this patent is extended or adjusted under 35 U.S.C. 154(b) by 314 days.

(21) Appl. No.: 10/524,722

(22) PCT Filed: Oct. 8, 2002

(86) PCT No.: PCT/EP02/11246

§ 371 (c)(1),
(2), (4) Date: Feb. 16, 2005

(87) PCT Pub. No.: WO2004/022882

PCT Pub. Date: Mar. 18, 2004

(65) Prior Publication Data

US 2005/0230189 A1 Oct. 20, 2005

(30) Foreign Application Priority Data

Sep. 5, 2002 (DE) ..... 102 41 537

(51) Int. Cl.
*B62D 61/12* (2006.01)

(52) U.S. Cl. ..... 180/209; 180/252; 280/6.157

(58) Field of Classification Search ..... 180/209, 180/24.07, 252, 253, 237, 238; 280/6.15, 280/6.157
See application file for complete search history.

(56) References Cited

U.S. PATENT DOCUMENTS

| | | | | | |
|---|---|---|---|---|---|
| 4,044,853 | A | * | 8/1977 | Melke | 180/167 |
| 4,127,182 | A | * | 11/1978 | Thole | 180/168 |
| 5,199,524 | A | * | 4/1993 | Ivancic | 180/237 |
| 5,219,412 | A | * | 6/1993 | Kubo | 180/246 |
| 5,526,890 | A | * | 6/1996 | Kadowaki | 180/8.3 |
| 5,823,884 | A | * | 10/1998 | Ager | 472/77 |

FOREIGN PATENT DOCUMENTS

| | | | |
|---|---|---|---|
| DE | 30 15 384 | | 10/1981 |
| DE | 3015384 | A * | 10/1981 |
| DE | 298 13 512 | | 1/2000 |

* cited by examiner

*Primary Examiner*—Paul N. Dickson
*Assistant Examiner*—Drew J. Brown
(74) *Attorney, Agent, or Firm*—Bachman & LaPointe, P.C.

(57) ABSTRACT

A transport drive, in particular for stage elements, fork-lift vehicles and moving platforms (R), comprising at least one element which is driven or may be driven, integrated in a base region of the stage element (R), whereby the at least one element for raising and lowering the stage element (R) may be driven on a foundation into the stage element (R).

11 Claims, 3 Drawing Sheets

TRANSPORT DRIVE IN PARTICULAR FOR STAGE ELEMENTS, FORK-LIFT VEHICLES AND MOVING PLATFORMS

BACKGROUND OF THE INVENTION

The present invention relates to a transport drive, in particular for stage elements, fork-lift trucks and movable platforms, having at least one element which is driven or can be driven and which is integrated in a base area of the stage element.

Transport drives of this type are known and familiar in many forms and designs. Normally, a motor element or the like is connected to one edge of a stage element in order to move or drive the stage element. The disadvantage with this is that conventional wheels or balls have a point contact with a stage, in particular with an arbitrary base. A stage element of this type supported by wheels is not stable and wobbles as it is moved on a base or on a stage.

The conventional transport drives for stage elements in addition permit only restricted movement of the stage element in one direction or the other, which is disadvantageous. Moving the stage elements during a performance is therefore not possible.

DE 30 15 384 A1 shows a theater stage having a stage The chassis of the stage wagon can be driven via an electric motor, it being possible for the chassis to be raised and lowered by means of a lifting cylinder via a complicated construction.

U.S. Pat. No. 4,127,182 discloses an automatically controlled motor-operated transport car, two of the wheels of the transport car being provided with their own steering and drive elements within the transport car.

U.S. Pat. No. 5,823,884 describes a similar transport wagon, which has its own driven and steerable rollers.

DE 298 13 512 U1 discloses a chassis for a displaceable stand, in which the rollers are mounted in a resilient and prestressed manner by means of a gas spring.

The present invention is therefore based on the object of providing a transport drive for a stage element which eliminates the aforementioned disadvantages and with which the stability of the stage element is to be increased substantially, even during movement, in a simple and cost-effective manner. In addition, independent movement of the stage element on a base, in particular on a stage, is to be ensured.

SUMMARY OF THE INVENTION

In the present invention, a stage element, a fork-lift truck or a movable platform is assigned at least one transport drive, preferably a plurality of transport drives. The transport drives are preferably arranged in corner regions of a base region. The transport drive itself has an element which is preferably formed in the manner of a roll. This element can be driven actively by a motor element and can be moved with respect to a base in order to raise the stage element or to set the latter down on the base again.

At the same time, this element or its housing is mounted such that it can be rotated about a vertical axis by means of a further motor element, so that the stage element can be moved in any desired directions and movement sequences on a base by means of appropriate positioning of the element and of the transport drive.

When the stage element or the fork-lift truck or a movable platform is moved with respect to the base, the elements are extended, so that the base region of the stage element is lifted off the base. As a result of forming the elements as a roll element, there is linear contact between element and base, so that in this way the stability during movement is increased.

After the stage element has been moved to a desired location, the element is retracted and the stage element is let down and rests securely with its base region on a stage or the base. It is possible for appropriate rubber elements, rubber supports or the like to be provided in the base region in order to increase the stability.

Brakes or the like are not necessary, so that the stage element stands in a stable manner on the base. This has the advantage that the stage element can also be moved during a performance, it being possible for the movement of the stage element to be controlled and regulated in a preferably wire-free manner. For this purpose, each stage element is assigned its own power sources and control devices, which feed the corresponding motor elements and the control device.

In this way, the possible applications of appropriate stage elements are increased considerably, so that a plurality of stage elements with a plurality of integrated transport drives can be moved simultaneously, aligned with respect to one another and can be controlled, even during a performance, in the region of the stage or of a base and can be set down stably at any desired points. In this case, the stage elements, the fork-lift trucks or moving platforms can be pivoted or moved about their own axes, about any desired points or moved in linear or circulating movements with respect to the base, depending on the position in the individual transport drive. The individual transport drives are preferably arranged in corner regions of the stage element, the at least one power source preferably being provided in a central region, close to the base region, in order to optimize the centre of gravity. However, the present invention is not restricted to this arrangement.

BRIEF DESCRIPTION OF THE DRAWINGS

Further advantages, features and details of the invention emerge from the following description of preferred exemplary embodiments and by using the drawing, in which.

DETAILED DESCRIPTION

Figure 1:
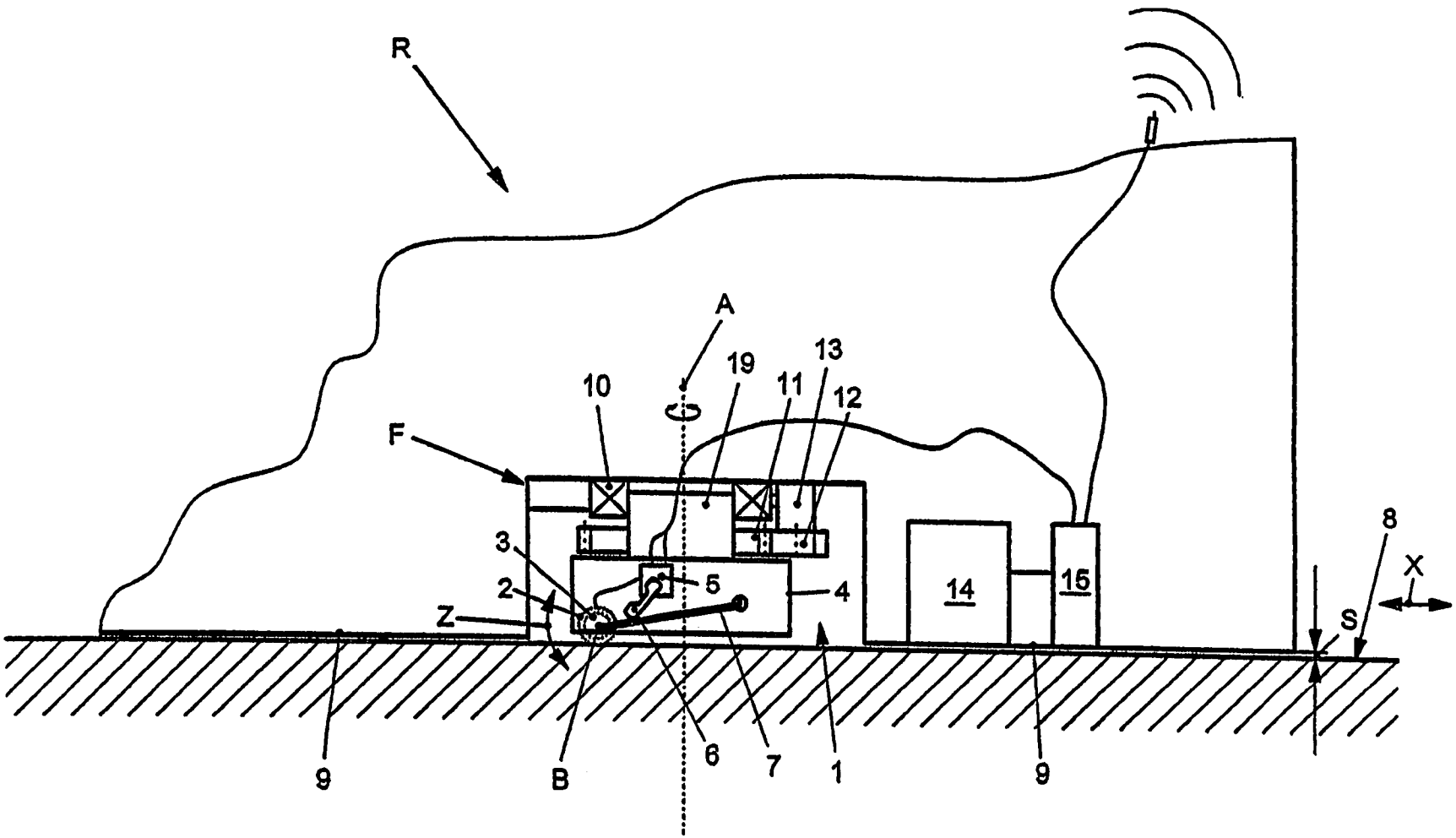
FIG. 1 shows a schematically illustrated partial longitudinal section through a stage element in a position of use, in particular in a base region.

According to FIG. 1, a stage element R according to the invention has a transport drive F which is inserted into a recess 1 in the stage element R. The transport drive F substantially comprises an element 2 which can be driven actively about an axis B by means of a motor element 3 which is indicated only here and integrated in order to move the stage element R to and fro in an X direction, as FIG. 1 indicates. The motor element 3 drives the element 2, which can preferably be formed as a drive roll, drive wheel or spherical wheel, precisely and exactly.

The element 2 is seated in a housing 4, in which an additional drive element 5 having a lever arm 6 is provided, in order to pivot the element 2, in particular the roll, which is pivotably mounted in the housing 4 at least by a crossmember 7, out of the housing 4 and against a base 8. The drive element 5 drives the lever arm 6 and pivots the element 2 in the Z direction illustrated. In this way, the stage element R can be raised slightly off the base 8, so that a small gap S is produced between a base region 9 and the base 8. In this position, the stage element R can be moved, driven by the element 2.

Furthermore, the housing 4 is mounted such that it can be rotated about an axis A with respect to the stage element R by a shaft 19 and bearing 10, at least one gear element 11 being seated on the shaft 19. An output gear 12 of a further motor element 13 assigned to the recess 1 or to the stage element R engages in said gear element 11.

In this way, the element 2 can be rotated exactly and precisely about the axis A such that it can be controlled and regulated, so that any desired direction for movement, in particular for driving the stage element R in the X or Y direction, is possible.

Furthermore, at least one rechargeable power source 14, which is connected to a control device 15, is assigned to the stage element R. Via the power source 14, the control device 15, motor elements 3 and 13 and also the drive element 5 are supplied. Here, motor elements 3 and 13 and drive element 5 are connected to one another via bus systems, merely indicated here, and can be driven by the control device 15. The control device 15 receives the appropriate control signals, preferably in a wire-free manner, from the outside from a central station, not numbered, in order to drive the individual transport drives F in an individual stage element R individually, also differently and also separately.

Figure 2:
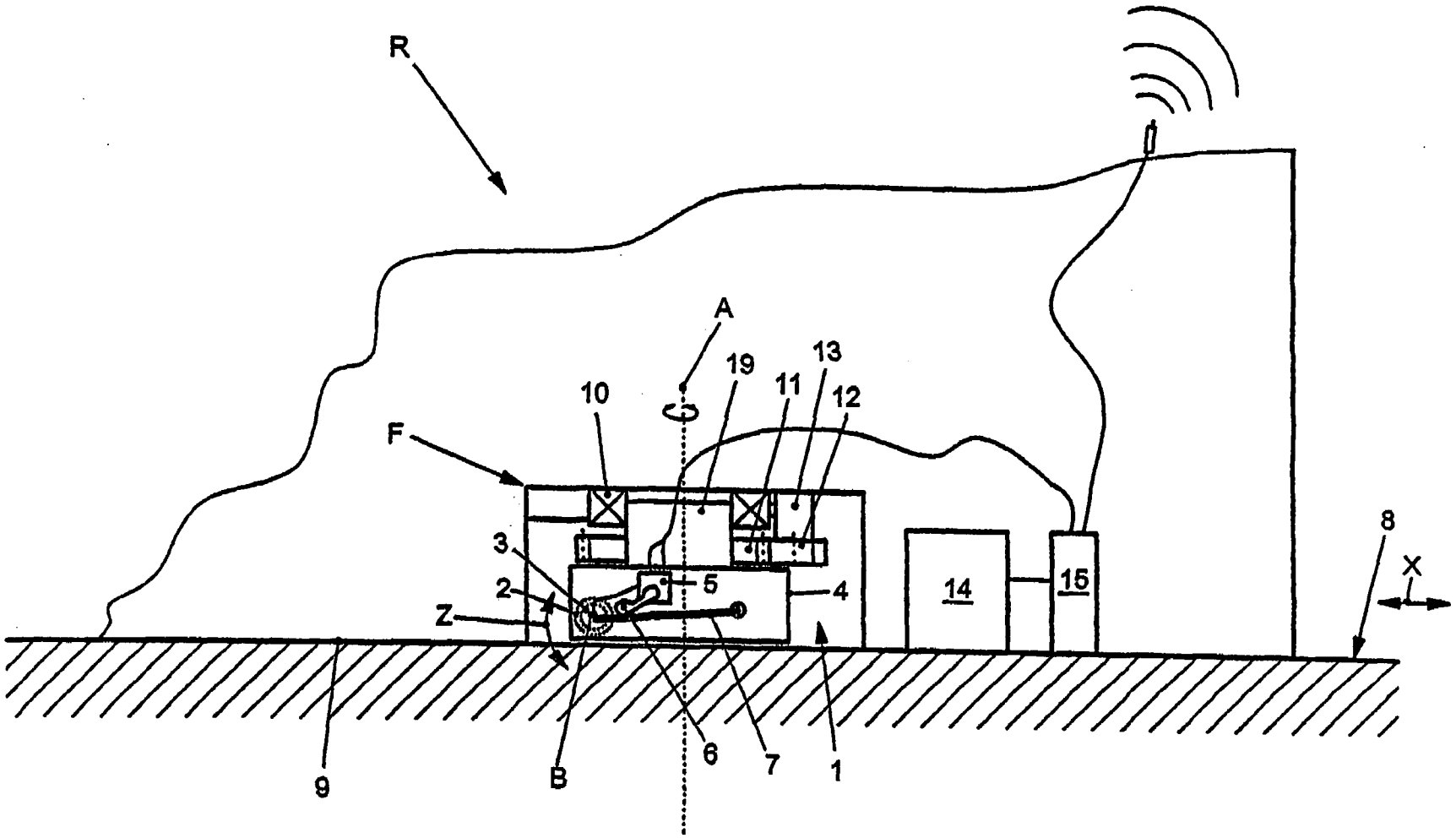
FIG. 2 shows a schematically illustrated partial longitudinal section of the stage element according to FIG. 1 in another position of use.

If the stage element R is to be moved, then, as indicated in the rest position according to FIG. 2, the element 2 moves out of the housing 4 against the base 8 and lifts the stage element R, which stands on the base 8, slightly, so that a gap S is produced in the base region 9. Then, via respective driving of the axis A of the transport drive F, the element 2 can be driven as desired in terms of direction and speed with respect to the base 8, depending on the desired direction of movement of the stage element R. In this case, a plurality of transport drives F can be provided in one stage element, in the base region 9, so that the stage element R can be moved as desired in an X direction and/or Y direction, see FIG. 3, with respect to the base 8. Here, the stage element R can itself be moved about any desired selectable points $P_1$ to $P_3$, rotated on the spot, can move around specific selectable points, can be moved on curved paths and in any movements laterally, in a curved fashion or in any other way on the base 8, in particular a stage.

Furthermore, in the present invention it is advantageous that, by regulating the drive element 5 by means of the lever arm 6, the crossmember 7 and therefore the element 2 can be moved into the housing 4, so that the stage element R can be set down on the base 8. As a result, the stage element R rests completely on the base 8, in particular in the base region 9, and in this way is set up safely and precisely. Appropriate rubber bearings or the like, not illustrated here, can be provided in the base region 9, in order to ensure high stability of the stage element R on the base 8, in particular on the stage.

Furthermore, in the present invention, it has proven to be advantageous to construct the elements 2 as roll elements, so that there is high linear contact with respect to the base 8; this likewise leads to high stability, even during operation, in particular even during the movement of the stage element R or during a performance.

In particular as a result of lowering the stage element R onto the base 8, a large contact area or standing area of the stage element R is implemented, so that stability is increased. No additional brakes are needed on the stage element, there being no play, for example, to move the stage element R or to set it oscillating.

Figure 3:
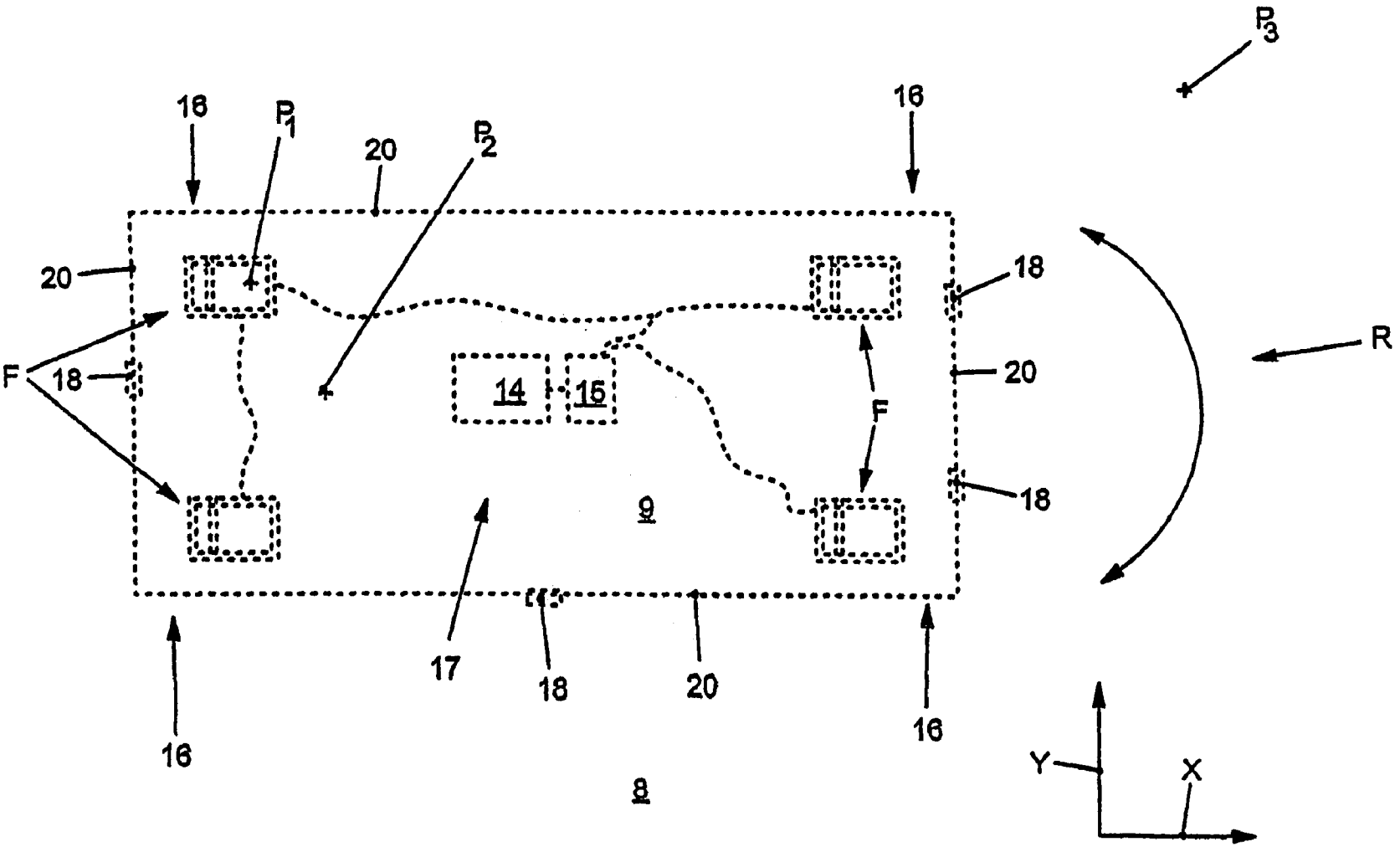
FIG. 3 shows a schematically illustrated plan view of a stage element having a large number of inserted elements for moving, raising and lowering the stage element with respect to a base.

In the present invention, it has also proven to be advantageous if a plurality of transport drives F, as illustrated in particular in FIG. 3, are provided in corner regions 16, the power source 14 and/or control device 15 being provided in a central region 17, for example. These are likewise used to optimize a center of gravity of the stage element R. The scope of the present invention is intended likewise to cover, for example, the provision of connecting elements 18 in side walls 20 of the stage element R, which can be used to attach further stage elements. In this way, a transport drive F for a stage element R is provided which offers many kinds of possibilities, so that each stage element R can be moved in any desired manner in an X direction and/or Y direction and can be moved rotatably about any desired points $P_1$ to $P_3$. In this way, remotely controlled stage elements R can be implemented which can be moved into any desired arrangements, even during a performance.

The invention claimed is:

1. A stage element having a base region and a transport drive integrated into the base region, said transport drive comprises at least one roller element connected to a first drive means for moving the at least one roller element between a retracted position wherein the stage element base region rests on a base and an extended position wherein the stage element base region is lifted off of the base, the transport drive further comprises a second drive means for rotating the at least one roller element about an axis A which is substantially perpendicular to the base region, and a third drive means for rotating the at least one roller element about an axis B such that, when the at least one roller element is in the extended position, the stage element moves along the base wherein the roller element is pivotably mounted in the housing on a cross member and a lever arm in connected between the cross member and the first drive means for actuating the cross member for pivotably moving the roller element.

2. The stage element according to claim 1, further including a plurality of transport drives integrated into different regions of the base region.

3. The stage element according to claim 2, wherein the plurality of transport drives are connected to one another via bus interfaces and can be driven jointly or individually.

4. The stage element according to claim 3, wherein the stage element has a rechargeable power source.

5. The stage element according to claim 1, wherein the at least one roller element is in a housing, in which the first drive means is provided in order to pivot the driven element in a Z direction.

6. The stage element according to claim 5, wherein the housing is inserted into a recess in the stage element, wherein the housing is flat and flush with the base region.

7. The stage element according to claim 6, wherein the housing is rotated through 360° about the axis A in the recess of the base element by the second drive means.

8. The stage element according to claim 7, wherein the housing is seated in the recess and mounted on a bearing such that it rotated by a shaft which is driven in rotation via a gear element by means of a further drive gear engaging in the latter and belonging to the second drive means.

9. The stage element according to claim 1, wherein via an at least one control device, the at least one at least one roller element can be driven rotationally, pivotable about the axis B, and rotatable about the axis A.

10. The stage element according to claim 9, wherein, via the at least one control device (15), wire-free driving from the outside is carried out in order to move the stage element and lower the stage element (R) onto a base (8).

11. The stage element according to claim 1, wherein a plurality of stage elements (R) can be driven in a wire-free manner so as to be rotatable as desired, movable in the X and/or Y direction and capable of being driven.

* * * * *